United States Patent [19]

Baron

[11] 4,059,742

[45] Nov. 22, 1977

[54] MICROWAVE SEAL FOR COMBINATION COOKING APPARATUS

[75] Inventor: David A. Baron, Edina, Minn.

[73] Assignee: Litton Systems, Inc., Beverly Hills, Calif.

[21] Appl. No.: 594,526

[22] Filed: July 9, 1975

[51] Int. Cl.[2] ..... H05B 9/06

[52] U.S. Cl. ..... 219/10.55 D

[58] Field of Search ..... 219/10.55 D, 10.55 F; 174/35 GC, 35 MS, 35 R

[56] References Cited

U.S. PATENT DOCUMENTS

| | | | |
|---|---|---|---|
| 3,182,164 | 5/1965 | Ironfield | 219/10.55 D |
| 3,584,177 | 6/1971 | Bucksbaum | 219/10.55 D |
| 3,629,537 | 12/1971 | Haagensen | 219/10.55 D |
| 3,633,564 | 1/1972 | Togashi | 219/10.55 D |
| 3,666,904 | 5/1972 | Krajewski | 219/10.55 D |
| 3,668,357 | 6/1972 | Kobayashi | 219/10.55 D |
| 3,678,238 | 7/1972 | Yasuoka et al. | 219/10.55 D |
| 3,803,377 | 4/1974 | Nakano | 219/10.55 D |
| 3,809,843 | 5/1974 | Takayama | 219/10.55 D |
| 3,846,608 | 11/1974 | Valles | 219/10.55 D |

*Primary Examiner*—Arthur T. Grimley
*Attorney, Agent, or Firm*—Robert E. Lowe

[57] ABSTRACT

An oven adapted to cook foods by the use of either conventional thermal heating or by microwave heating, or both simultaneously, is disclosed which includes a microwave seal for preventing the emission of microwave energy beyond the cooking cavity. The microwave seal can withstand temperatures in the pyrolytic cleaning range, does not deteriorate with repeated use and discourages soil accumulation.

15 Claims, 4 Drawing Figures

MICROWAVE SEAL FOR COMBINATION COOKING APPARATUS

BACKGROUND OF THE INVENTION

It is well known in the field of microwave heating that it is necessary to provide means to confine microwave energy within a heating cavity or enclosure. Such requirements include the use of sealing arrangements between the cavity and the door covering the entrance thereto in order to reduce microwave transmission or leakage at that interface to a minimum.

Various sealing arrangements have been suggested in the art. These include absorptive seals, contact seals and choke seals. Absorptive seals typically place microwave energy absorptive material in the area of the cavity-door interface to absorb microwave energy reaching that area. Contact seals provide electrical, typically metal-to-metal, contact between the door and the cavity to prevent passage of microwave energy. Choke seals employ the principle of a short circuited microwave transmission line, making use of known characteristics of microwave energy occuring at various ¼ wave length intervals.

In recent years it has proven desirable to incorporate heating by both conventional thermal means and by microwave energy into a single cavity, such as in a free standing range. Since such an appliance can accomplish heating and cooking by conventional means, it is subject to the hard soiling found in conventional ovens. It is therefore desirable to make such an appliance selfcleaning, which may in turn encompass the use of temperatures well above the normal cooking level to accomplish cleaning by controlled pyrolysis. The presence of temperatures in the pyrolytic temperature cleaning range renders many methods and materials commonly used in microwave appliances unsuitable for a combination thermal/microwave oven.

One solution that has been suggested is the use of a contact seal accomplished with a gasket of metallic mesh captured between the door and the oven cavity. Such an arrangement has serious disadvantages. Good sealing depends upon continuous contact around the entire periphery of the door which is difficult to accomplish initially, and more difficult to maintain as the appliance is used and the gasket is subject to wear. Moreover, such appliances are conventionally made of porcelainized steel, and the porcelain finish is a sufficient electrical insulator to prevent electrical contact. Therefore, in such prior art arrangements it was necessary to apply a special metallic coating to the peripheral area in contact with the gasket.

An arrangement consisting of a combination of all three types of seals has been suggested in the prior art. While such an arrangement may be effective in preventing microwave leakage, it is also more complex and expensive than is commercially desirable.

It is therefore an object of the present invention to provide an effective door seal apparatus to prevent the leakage of microwave energy from a cooking cavity, which apparatus is capable of withstanding exposure to pyrolytic cleaning oven temperatures without detremental effect on its performance.

Another object of the present invention is to provide a sealing arrangement for the interface between a cooking cavity and the cavity door which is effective in preventing the escape of significant levels of microwave energy, is able to withstand heat cleaning temperatures in excess of 750° F, and is relatively simple and inexpensive to manufacture.

A still further object of the invention is to provide a choke-type sealing arrangement including a chamber configured to discourage the accumulation of soil in and around the chamber without the use of additional components.

A still further object of the invention is to provide a microwave seal for a combination cooking appliance which seal is not subject to deterioration or diminution of effectiveness due to age or repeated use of the appliance.

Further objects and advantages to the invention will become obvious as the description proceeds.

SUMMARY OF THE INVENTION

In accordance with the present invention, there is provided an oven including a cooking cavity having an access portion, and a door adapted to close over the cavity access to form an enclosed cavity in which both microwave cooking and conventional thermal cooking may be conducted. The door includes a pair of inner panels arranged in spaced relationship to form a chamber therebetween, the chamber being located around the periphery of the cooking cavity. One of the inner panels includes a flange portion forming a portion of the chamber and adapted to contact a thermal sealing gasket about the periphery of the cavity when the door is closed. The chamber is constructed so that it discourages the accumulation of soil, grease and the like in the chamber area.

In certain embodiments of the invention, additional brackets may be added to the interior or exterior of the cavity in order to further reduce microwave energy emissions. Further, an absorptive seal may be located away from the area of high temperature to further attenuate the emission of microwave energy from the appliance.

DESCRIPTION OF THE DRAWINGS

The detailed construction of the microwave energy seal of the present invention will be described and illustrated in detail by reference to the accompanying drawings in which.

DESCRIPTION OF PREFERRED EMBODIMENTS

Figure 1:
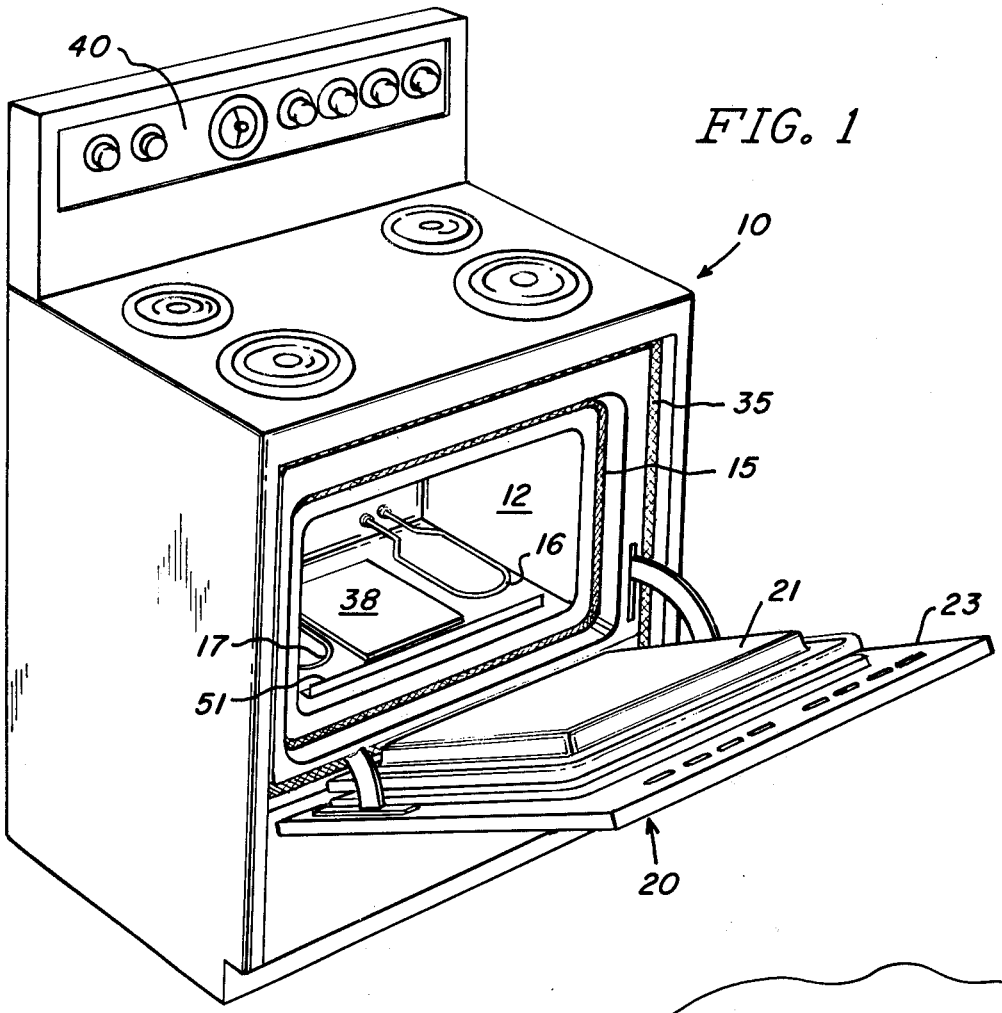
FIG. 1 is a frontal perspective view of a combination microwave/thermal cooking range with the door in the open position and one door hinge partially cut away to illustrate the oven interior.
Figure 2:
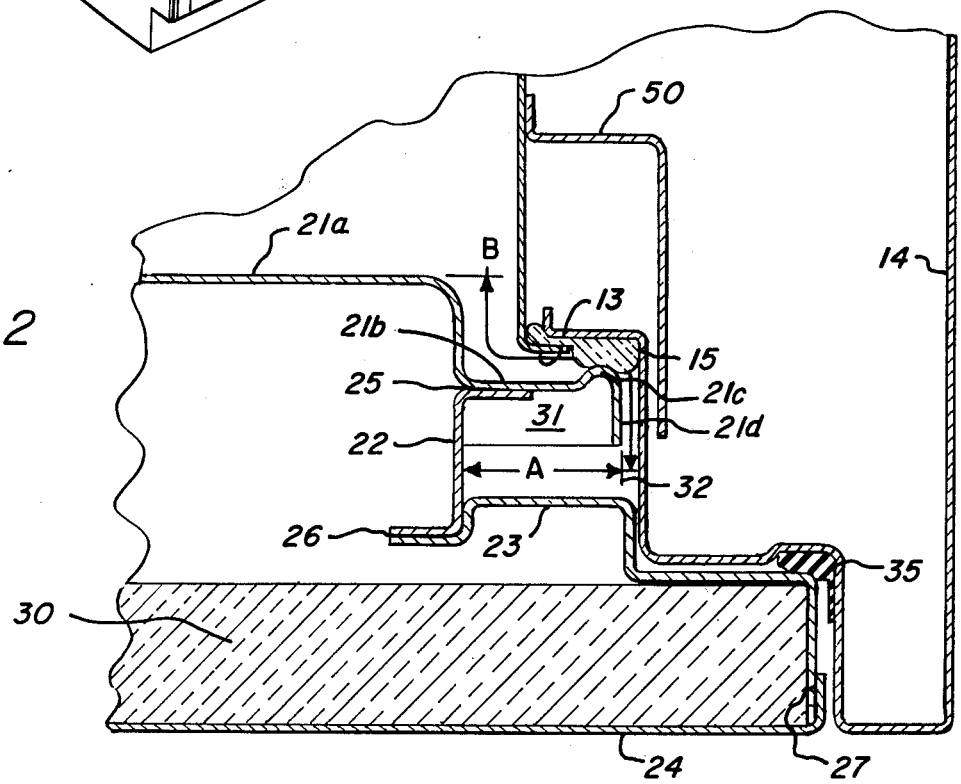
FIG. 2 is a partial horizontal cross section of the cooking range of FIG. 1 showing the door in the closed position and illustrating detailed construction of the microwave seal and the door-oven interface area.
Figure 3:
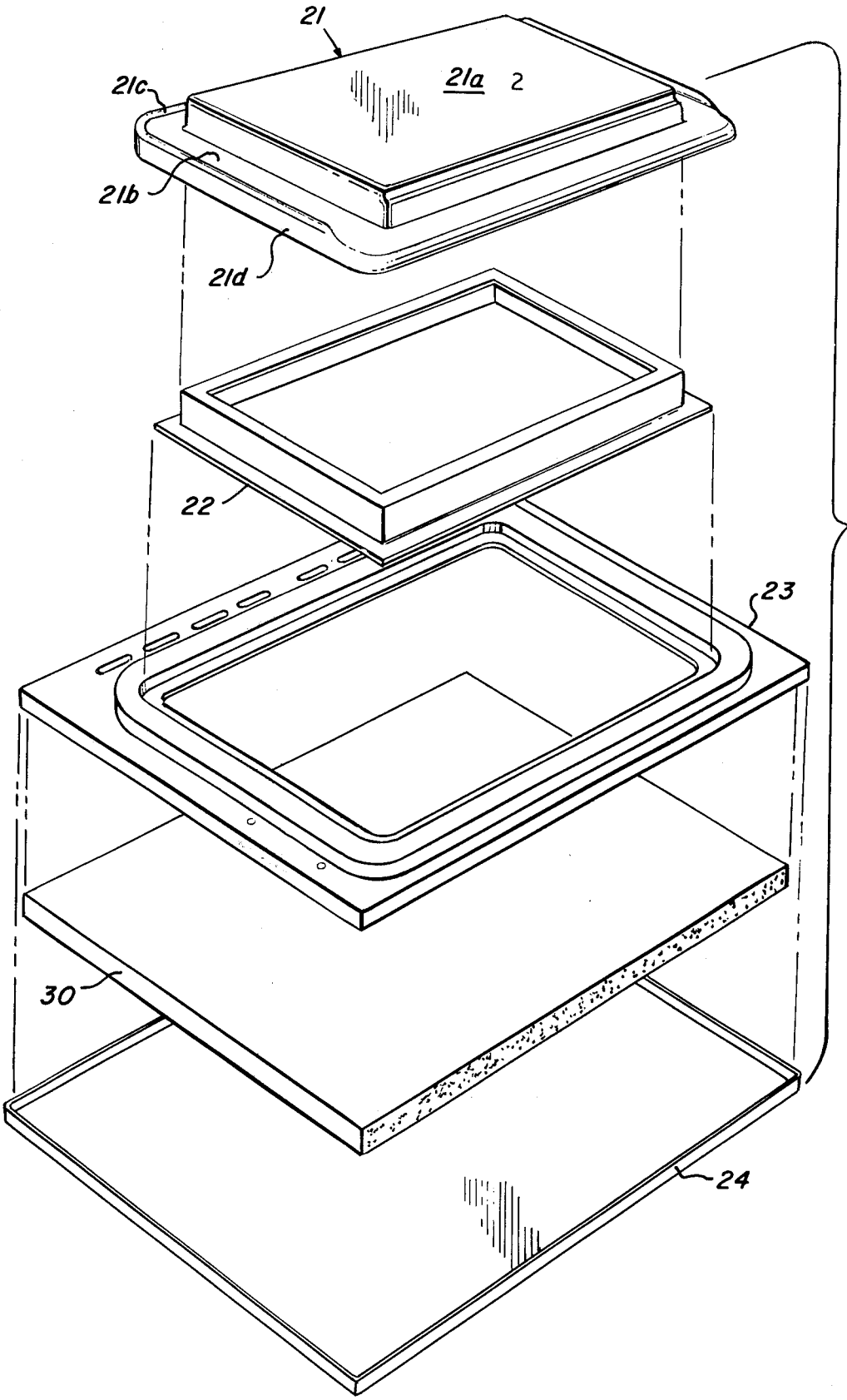
FIG. 3 is an exploded view of the door illustrating the configuration of the door components.
Figure 4:
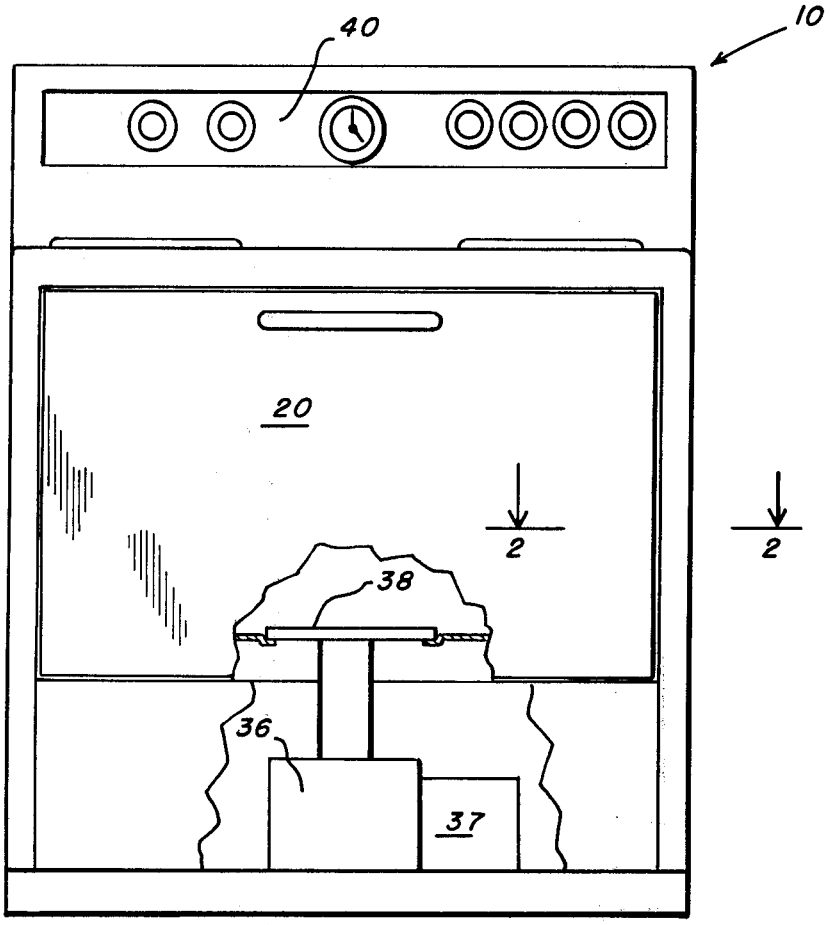
FIG. 4 is a front view in elevation of the cooking range, partially cut away to show the positioning of the microwave energy feed system.

In the drawings there is illustrated a cooking appliance 10 having a cooking cavity 12 and a door 20 adapted to cover the access portion of cavity 12 when in the closed position to form an enclosed cooking cavity. While cooking appliance 10 is depicted as a free standing household range, it will be understood that the present invention can be applied to other configurations of cooking appliances which are designed to provide both microwave and thermal energy for cooking in a single cavity.

Cavity 12 includes a peripheral flange portion 13 which extends around and defines the open, access portion of cavity 12. Cavity 12 is attached to the support frame 14 by means of suitable fasteners or by welding. Gasket 15 is captured between the support frame 14 and peripheral flange portion 13 of cavity 12. Gasket 15 extends about the entire periphery of cavity 12.

In operation, gasket 15 functions as a thermal barrier to reduce the transfer of heat from the interior of cavity 12 to the external surfaces of frame 14 and door 20. The gasket may be made of a variety of thermally insulative materials. A woven metal mesh filled with fiberglass is suitable, but other materials may be substituted by those skilled in the art. Although the outer jacket of gasket 15 may be a metal mesh, there is no requirement that an electrically conductive material be employed and gasket 15 can be constructed entirely of electrically nonconductive thermally insulative materials if so desired.

Positioned within cavity 12 are one or more thermal heating elements 16 and 17. These elements are connected to a suitable source of electrical power to resistively product heat in a manner well known in the art. Elements 16 and 17 are customarily positioned in the top and bottom areas respectively of cavity 12 and are conventionally employed for baking and/or broiling of foods. The heating elements can also be used to heat the cavity interior to temperatures above about 750° F for the purpose of removing soil from the walls of the cavity in a special pyrolytic or heat cleaning cycle.

Door 20 may be manufactured employing a variety of known metal forming techniques such as casting, rolling, pressing and the like. Preferably, the door 20 may be constructed of a number of pre-formed porcelain coated steel components such as inner panel 21, bracket 22, panel 23 and outer panel 24. The individual components may be assembled using various fastening techniques, and are preferably assembled by welding at the interconnecting areas such as 25, 26 and 27. It is also preferred to fill the space between panel 23 and panel 24 with a suitable heat insulating material 30, which may be fiberglass or the like.

Inner panel 21 is constructed to project slightly into cavity 12 when door 20 is closed. Hence the panel 21 comprises a central portion **21*a* turned at its periphery to form a generally pan shaped configuration, a flange portion 21*b*, a generally U-shaped transition portion 21*c*, and a rim portion 21*d***.

The central portion **21*a* of panel 21 extends across the front face of cavity 12 when the door 20 is closed. In such position, flange portion 21*b* lies approximately parallel to and spaced from flange portion 13 of cavity 12. Transition portion 12*c* is in contact with gasket 15 around the periphery of the cavity. Rim portion 21*d* extends away from cavity 12 toward panel 23, but a substantial gap exists between rim portion 21*d* and panel 23** as will be more fully explained hereinafter.

As shown in FIG. 1, a chamber 31 is formed by portions of panels 21 and 23, as well as bracket 22. The entrance area 32 to the chamber 31 is defined by panel 23 and the edge of rim portion **21*d* of inner panel 21. The chamber 31 and the entrance area 32 are dimensioned and positioned in order to make use of the quarter wavelength characteristics of microwave energy. Preferably, the depth of chamber 31 measured from the entrance area 32 to the rear wall defined by bracket 22 is approximately equal to $\lambda/4$, where $\lambda$ is the wave length of the microwave energy determined by the relationship $\lambda = c/f$, wherein $c$ is the speed of light and $f$ is the frequency of the microwave energy. Similarly the entrance area 32 is located at a distance of approximately $\lambda/2$ from the interior of the oven measured along the meandering path formed by the gap between portions of cavity 12 and frame 14 on one side and by portions of inner panel 21 on the other side. The depth of chamber 31** and the length of the path are shown in the drawings as dimensions A and B respectively.

Thus it can be seen that when microwave energy at a frequency of 2450MHz is employed in cavity 12, it is preferred to have dimension A equals to approximately 1.2 inches (3.05 CM), and dimension B equal to approximately 2.4 inches (6.1 CM). A chamber of such dimension fits quite easily into the overall dimension of the oven door of a conventional free standing range without causing a distorted or unsightly appearance. It has been found that a chamber so located and dimensioned as described is very effective in terminating the propagation of microwave energy of the primary frequency of 2450MHz. Appropriate dimensional modifications can, of course, be made by those skilled in the art to accommodate other primary microwave frequencies by maintaining the $\lambda/4$ and $\lambda/2$ relationship.

In order to prevent the emission of second and third harmonics of the primary microwave frequency, gasket 35 is positioned around frame 14 positioned around the periphery of door 20. Gasket 33 is selected from a variety of available materials that have microwave absorptive properties, are flexible and have some measure of temperature tolerance. For example, gasket 35 may be composed of carbon loaded vinyl material. For applications where warmer temperatures are possible, as in an oven incorporating a pyrolytic cleaning cycle, it is preferred that gasket 35 be composed of a carbon loaded silicon rubber material.

In a preferred embodiment of the invention, channel 50 may be provided along the sides and top and bottom of cavity 12, the open portion of the channel facing the front of the cooking appliance 10. It has been found that channel 50 is quite effective in preventing the emission of microwave energy from the back of the cooking appliance, as it acts as a reflective barrier for microwave energy that may pass toward the back of the appliance from the area around gasket 15.

Similarly, a second channel 51 may be added at the bottom of cavity 12, the open portion of the channel facing the interior of the cavity. Channel 51 is particularly effective in directing the microwave energy within cavity 12 away from the bottom hinge area of door 20 and substantially reduces the level of microwave energy leakage in that area. Thus channels 50 and 51 cooperate with chamber 31 to direct and control the transmission of microwave energy within and beyond the appliance in a manner that assures that emissions are held to acceptable levels.

Microwave energy is generated by a magnetron 36 having a power supply 37, each of which can be of the type well known in the art. The output of magnetron 36 is fed into cavity 12 through a feed window 38 position in the bottom wall of cavity 12, although the microwave energy may be supplied to the cavity using a number of other arrangements generally known to those skilled in the art.

OPERATION

In the operation of the cooking appliance 10 food to be cooked is introducted into the cavity 12. The food may be cooked using either conventional thermal heating, microwave heating, or a combination of both as appropriate. The one mode or the other of cooking the food stuff is selected by the appliance user by operating controls located on the control panel 40.

When conventional thermal heating is to be used in cooking, either by itself or in combination with microwave energy, power is supplied to heating elements 16 and 17 in order to heat the oven cavity 12 to the selected temperature.

When microwave heating is desired, again either by itself or in combination with thermal heating, power is supplied to magnetron 36 and microwave energy is transmitted to cavity 12 through feed window 38.

Regardless of the type of cooking selected, the door 20 is, of course, placed in closed position so that the curved transition portion 21*c* of inner panel 21 is in contact with gasket 15 thereby serving to retain heat within the cavity 12. Closing door 20 also serves to position chamber 31 about the front periphery of cavity 12 so that it is in proper position to serve to terminate the emission of microwave energy from the cavity.

With the door 20 in the closed position, the central portion 21*a* of inner panel 21 provides a wall across the front access portion of the oven cavity, substantially closing the cavity. Any microwave energy of the primary frequency which escapes through the small space between the flange 13 of the cavity and inner panel 21 is prevented from escaping to the exterior of the appliance by chamber 31 which acts as a choke type seal. Any microwave energy of the second or third harmonics of the primary frequency is absorbed by gasket 35 and thereby prevented from escaping to the exterior of the appliance.

When it is desired to claim a soil from the inside walls of cavity 12, the operator may select a special pyrolytic cleaning cycle through the operation of appropriate controls on panel 40. In this mode, power is supplied to the heating elements 16 and 17 to cause the temperature in the interior of the cavity to rise above that used in normal cooking, and preferably above 750° F. The air space provided between inner panel 21 and panel 23 provides a good thermal insulation to prevent the transmission of such heat to the exterior surface of panel 24. Moreover, the addition of insulating material between panel 23 and outer panel 24 further reduces the heat so transferred. Finally, gasket 15 acts as a thermal barrier around the periphery of cavity 12 to prevent the transfer of heat to the exterior of the cooking appliance. In this manner, the exterior surfaces, which may be contacted by the user of the appliance, are kept at a temperature sufficiently low so as to be harmless for human contact.

Thus it can be seen that the present invention provides a simply constructed, economical means of providing a shield for both microwave energy and thermal heat from a cooking appliance. Because of the unique configuration of cavity 31, a microwave sealing arrangement is provided which discourages the accumulation of soil therein, which was a significant problem in many of the prior art devides. Moreover, because chamber 31 is ridgedly constructed and positioned, its performance as a microwave energy seal will not degrade or deteriorate with continued use of the appliance. In the prior art devices which relied upon some type of flexible seal arrangement to maintain an area of contact between the door and the oven cavity, there was a continuing possibility that the seal would become brittle or break with age and use, thereby becoming continually less efficient. Moreover, the accumulation of soil on the surfaces may interrupt electrical contact required by some prior art methods. The present invention overcomes that problem by providing a seal which is capable of an extended life cycle without substantial change in performance.

In the foregoing specification and drawings, the present invention has been described and shown in considerable detail. However, it will be understood that such detail is for the purpose of illustration and not by way of limitation, and that the scope of the invention is defined in the appended claims.

I claim:

1. A cooking appliance comprising in combination:
- a frame;
- a cooking cavity having a front access portion, said cavity being supported in said frame;
- means for thermally heating said cavity;
- means providing microwave energy to said cavity at a preselected frequency;
- a door mounted on said frame adapted for movement between an open and a closed position and including an interior face portion, said interior face portion substantially covering said front access portion of said cavity when said door is in the closed position;
- said door including means defining an annular chamber extending around the periphery of said front access portion when said door is closed, said chamber including an entrance portion located outside of and faced away from said cavity, said entrance portion being spaced away from said interior face portion a distance approximately equal to one-half wavelength of the microwave energy at said preselected frequency, said chamber having a dimension measured from said entrance portion of the rear wall of said chamber approximately equal to one-fourth wavelength of the microwave energy at said preselected frequency.

2. The apparatus of claim 1 wherein said door is constructed from a plurality of discreet panels including an outer panel, an intermediate panel secured to said outer panel about its periphery and providing a heat insulative space therebetween, and an inner panel including said interior face portion, said inner panel attached to said intermediate panel by bracket means, whereby said chamber is defined by portions of said intermediate panel, said bracket means, and said inner panel.

3. The apparatus of claim 2 wherein said bracket means defines the rear wall of said chamber.

4. In a domestic cooking appliance of the type including an oven having an oven door, wherein said oven can be heated by thermal energy to temperatures in the heat cleaning range, the improvement comprising:
- means providing microwave energy to said oven;
- sealing means to confine said microwave energy within said oven, said sealing means including an annular chamber of substantially rectangular cross-section and dimensioned to present a short circuited transmission line for said microwave energy located about the periphery of said oven when said door is in the closed position, said chamber having an entrance portion in one wall thereof, said entrance portion facing away from the entrance to said oven.

5. The apparatus of claim 4 wherein said annular chamber is formed in said door.

6. The apparatus of claim 4 wherein said chamber has a depth measured from said entrance portion to the real wall opposite said entrance equal to approximately one-fourth the wavelength of said microwave energy.

7. The apparatus of claim 4 including a first gasket positioned about said oven entrance portion, said gasket being in contact with said chamber when said door is closed to reduce the transmission of thermal energy from said oven.

8. The apparatus of claim 7 including a second gasket positioned about said oven outwardly from said first gasket, said second gasket containing a microwave absorptive material.

9. The apparatus of claim 8 wherein said second gasket is composed of a carbon loaded silicone rubber material.

10. The apparatus of claim 4 including microwave reflective means positioned in the lower front portion of said oven to reflect microwave energy toward the interior of said oven and away from the hinge portion of said door.

11. The apparatus of claim 4 including reflective channel means mounted to the exterior walls of said oven, said channel having an open portion faced toward the front of said oven.

12. The apparatus of claim 4 wherein said oven door comprises first outer panel means, second mediate panel means secured to said first outer panel means, bracket means secured to said second mediate panel means, and third inner panel means attached to said bracket means, whereby said annular chamber is formed by said bracket and said second and third panel means.

13. The apparatus of claim 12 wherein said third panel means includes a rim portion turned outwardly toward the oven front and spaced away from said second panel means whereby said entrance portion of said chamber is formed by the resulting gap between said rim portion and said second panel.

14. The apparatus of claim 13 wherein the depth of said chamber is defined by the distance between said rim portion and said bracket means.

15. A domestic cooking appliance having a cooking cavity formed by a substantially box-shaped oven liner and a front opening access door, an outer oven cabinet surrounding said oven liner; heating means for supplying heat energy to said cooking cavity; microwave generating means for supplying microwave energy to said cooking cavity, said access door including microwave energy seal means comprising an annular chamber positioned to encircle said cooking cavity when said door is in the closed position, said chamber having an open, entrance portion faced toward the outer periphery of said door, said chamber being dimensioned to short circuit said microwave energy to substantially prevent its transmission from said cavity.

* * * * *